US010844596B2

(12) United States Patent
Laufer

(10) Patent No.: US 10,844,596 B2
(45) Date of Patent: Nov. 24, 2020

(54) STRUCTURAL MEMBER FOR USE IN AN INSULATED ASSEMBLY BETWEEN TWO BUILDING STRUCTURES

(71) Applicant: Price Industries Limited, Winnipeg (CA)

(72) Inventor: Lance Laufer, Winnipeg (CA)

(73) Assignee: Price Industries Limited, Winnipeg (CA)

( * ) Notice: Subject to any disclaimer, the term of this patent is extended or adjusted under 35 U.S.C. 154(b) by 0 days.

(21) Appl. No.: 16/406,602

(22) Filed: May 8, 2019

(65) Prior Publication Data

US 2019/0360194 A1 Nov. 28, 2019

Related U.S. Application Data

(60) Provisional application No. 62/675,422, filed on May 23, 2018.

(51) Int. Cl.
*E04B 1/78* (2006.01)
*E04B 1/76* (2006.01)

(52) U.S. Cl.
CPC ..... *E04B 1/78* (2013.01); *E04B 1/7608* (2013.01)

(58) Field of Classification Search
CPC ..... E04B 2/7412; E04B 1/78; E04B 1/7608; E04C 3/09; E04D 13/1681
See application file for complete search history.

(56) References Cited

U.S. PATENT DOCUMENTS 4,016,700 A 4/1977 Blomstedt
5,551,135 A * 9/1996 Powers, III ..... B21D 47/02 29/6.1
7,866,112 B2 * 1/2011 Edmondson ..... E04B 1/24 52/633
8,201,384 B2 * 6/2012 Krestel ..... E04C 3/38 52/840
8,677,718 B2 * 3/2014 Marshall ..... E04D 3/3608 52/655.1

(Continued)

FOREIGN PATENT DOCUMENTS

CA 2373888 C * 8/2003 ..... E04C 3/291
DE 202011000117 * 6/2011

(Continued)

*Primary Examiner* — Babajide A Demuren
(74) *Attorney, Agent, or Firm* — Ryan W. Dupuis; Ade & Company Inc.; Kyle R. Satterthwaite

(57) ABSTRACT

A structural member acts for distance keeping, stiffening and load-supporting structural framing between a first building structure and a second building structure across which there exists a temperature differential, for example the inner and outer casings of an air handling unit supported externally of the building so as to be exposed to outdoor weather. The structural member has a web portion spanning between mounting portions connecting opposing first and second edges of the web portion to the first and second building structures respectively. A plurality of slots are penetrated through the web portion at spaced apart locations relative to one another to be primarily non-parallel to the first and second edges. Some of the material bridges between the slots require heat transfer across the bridge to travel opposite to the direction of the temperature gradient direction.

19 Claims, 3 Drawing Sheets

(56) References Cited

U.S. PATENT DOCUMENTS

| | | | | |
|---|---|---|---|---|
| 2012/0000149 | A1 | 1/2012 | Rice | |
| 2016/0281363 | A1* | 9/2016 | Anderson | E04C 3/09 |
| 2017/0241137 | A1* | 8/2017 | Stevens | E04B 2/60 |

FOREIGN PATENT DOCUMENTS

| | | | | |
|---|---|---|---|---|
| EP | 1312725 | | 5/2003 | |
| WO | 201601580 | | 1/2016 | |
| WO | WO-2016120867 | A1 * | 8/2016 | E04B 2/8629 |

* cited by examiner

STRUCTURAL MEMBER FOR USE IN AN INSULATED ASSEMBLY BETWEEN TWO BUILDING STRUCTURES

This application claims the benefit under 35 U.S.C.119(e) of U.S. provisional application Ser. No. 62/675,422, filed May 23, 2018.

FIELD OF THE INVENTION

The present invention relates to a structural member for structural connection between two building structures, and more particularly the present invention relates to a structural member which is part of an assembly providing some heat insulation between a temperature differential existing between the two building structures.

BACKGROUND

A common building structure includes an outer envelope formed by outer walls of the building which are exposed to outdoor weather and an inner envelope formed by inner walls of the building which surround an occupied space of the building containing condition air therein such that there exists a temperature differential between the inner and outer walls. To minimize heat transfer, it is common to employ various insulating materials between the inner and outer walls, forming an overall heat insulating assembly of the building. To maintain structural integrity of the building, at least some structural elements are typically required between the inner and outer walls across which heat can be conducted more readily than non-structural insulating materials, often referred to as a thermal bridge. The rate of heat transferred across a structure is governed by the temperature difference, the thermal conductivity, the area, and, the distance the heat has to travel.

The following patent documents disclose various attempts to make structural members in a building structure more insulating than a solid and continuous structure: UK patent application no. 2512565 by Stewart Dalgarno, PCT publication no. WO2016/001580 by Jean-Christophe Vigouroux et al, US Patent application publication no. 2012/0000149 by John Rice, U.S. Pat. No. 7,866,112 by Edmondson, and U.S. Pat. No. 4,016,700 by Blomstedt. In each instance, gaps and/or slots are providing having edges which are primarily oriented parallel to the longitudinal direction of the structural member and which are aligned with adjacent ones of the gaps and/or slots so as to introduce many lines of weakness in the structure member. When forming sheet metal into a structure member by folding for examples, the lines of weakness formed by the slot pattern result in difficulty in folding of the sheet metal at the desired location apart from the slot location.

SUMMARY OF THE INVENTION

According to one aspect of the invention there is provided a structural member for use as a distance keeping, stiffening and load-supporting structural framing element between a first building structure and a second building structure across which there exists a temperature differential, the structural member comprising:

a web portion which is elongate in a longitudinal direction of the structural member and which includes opposing first and second edges of the web portion that extend in the longitudinal direction of the structural member, the web portion spanning between the first and second edges in a temperature gradient direction oriented perpendicularly to the longitudinal direction;

a first mounting portion joined to the web portion along the first edge of the web portion so as to be oriented transversely to the web portion for structural connection to the first building structure;

a second mounting portion joined to the web portion along the second edge of the web portion so as to be oriented transversely to the web portion for structural connection to the second building structure; and a plurality of slots penetrated through the web portion at spaced apart locations relative to one another;

the slots being oriented primarily non-parallel to the first and second edges of the web portion.

According to a second aspect of the present invention there is provided an air handling unit for supplying air to a building structure in which the air handling unit is supported externally of the building structure, the air handling unit comprising:

an outer casing adapted to be supported externally of the building so as to be exposed to outdoor weather;

an inner casing supported internally within the outer casing so as to receive conditioned air therein for circulation within the building structure in which the inner casing is spaced apart from the inner casing by an insulating gap therebetween; and a plurality of structural members connected between the inner casing and the outer casing for use as a distance keeping, stiffening and load-supporting structural framing element between inner casing and the outer casing, the structural member comprising:

a web portion which is elongate in a longitudinal direction of the structural member and which includes opposing first and second edges of the web portion that extend in the longitudinal direction of the structural member, the web portion spanning between the first and second edges in a temperature gradient direction oriented perpendicularly to the longitudinal direction;

a first mounting portion joined to the web portion along the first edge of the web portion so as to be oriented transversely to the web portion for structural connection to the first building structure;

a second mounting portion joined to the web portion along the second edge of the web portion so as to be oriented transversely to the web portion for structural connection to the second building structure; and a plurality of slots penetrated through the web portion at spaced apart locations relative to one another;

the slots being oriented primarily non-parallel to the first and second edges of the web portion.

The purpose of the slotted structural member according to the present invention is to reduce the heat transferred from the inner wall to an outer wall through the connecting flange in a metal panel design.

The slotted structural member according to the present invention is designed to reduce the heat transfer area as well as introducing an air gap thermal barrier significantly reducing the overall thermal conductivity of the flange.

Although a small air gap in a sheet metal flange has very little absolute resistance, it has tremendous relative resistance. When using a 5052 aluminum flange the addition of a 0.006 cut can theoretically increase the thermal resistance of the flange by over 900%.

The challenge is to maintain the required structural strength of the flange, as a complete cut is not possible, while maintaining strength. The slotted structural member according to the present invention design incorporates shapes that allow for material bridges while maximizing the total cut length and maintaining sufficient strength to allow for proper bending, and final structural requirements.

Ideally the shapes are design to prevent continuous lines of cuts parallel to the bend pattern to resist introduction of longitudinally oriented lines of weakness into the structural member.

Preferably the slots are oriented so as to be primarily non-parallel and non-perpendicular to the first and second edges of the web portion.

Preferably each slot is non-linear in shape between opposing ends of the slot.

Preferably the slots include a plurality of arcuate shaped slots having different radii of curvature relative to one another.

When each slot defines an apex between a pair of opposing ends of the slot, the apex of each slot is preferably (i) misaligned in both the gradient direction and the longitudinal direction relative to the apex of more than one adjacent slot, and/or (ii) misaligned in both the gradient direction and the longitudinal direction relative to the ends of at least one adjacent slot. Preferably the ends of each slot are also misaligned in both the gradient direction and the longitudinal direction relative to the ends of at least one adjacent slots.

When at least some of the slots comprise a non-linear slot extending between opposing ends of the slot, preferably at least some of the slots traverse an imaginary line connected between the ends of respective ones of the non-linear slots so as to be at least partly nested into the respective ones of the non-linear slots.

Preferably the slots include a plurality of first slots which are arcuate in shape such that a convex edge of the slot is nearest to the first edge of the web portion and a plurality of second slots which are arcuate in shape such that a concave edge of the slot is nearest to the first edge of the web portion. Preferably each first slot includes at least one second slot adjacent thereto.

When the slots define a plurality of material bridges connected between respective adjacent pairs of the slots, the slots are preferably located such that at least some of the material bridges require heat transfer across the bridge to travel opposite to the direction of the temperature gradient direction.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 1:
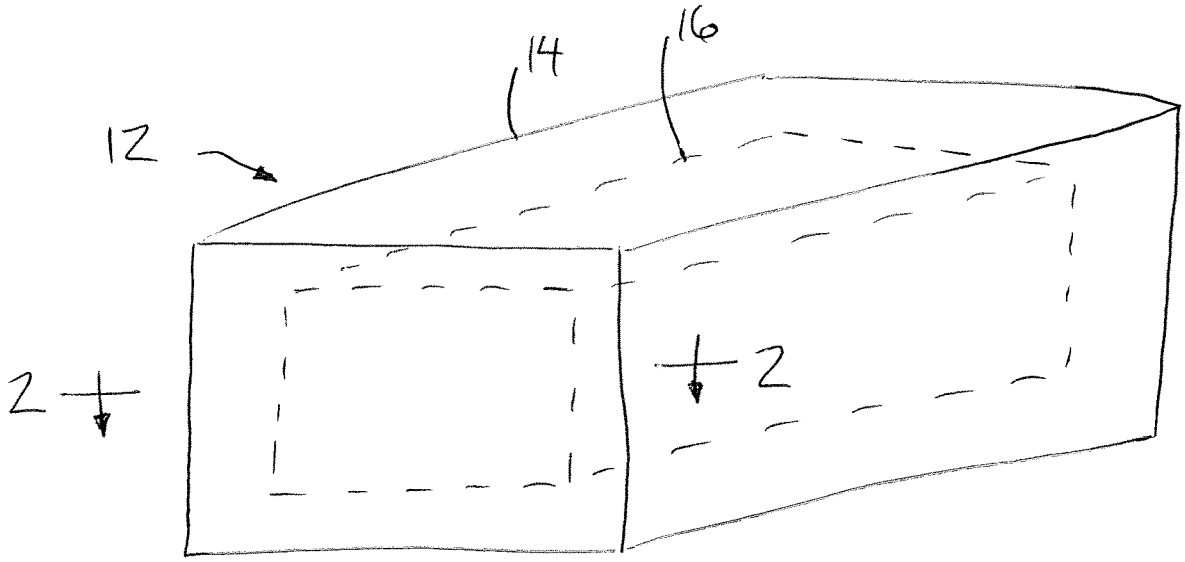
FIG. 1 is a schematic representation of an exemplary building structure comprising an air handling unit which incorporates the structural member according to the present invention therein.
Figure 2:
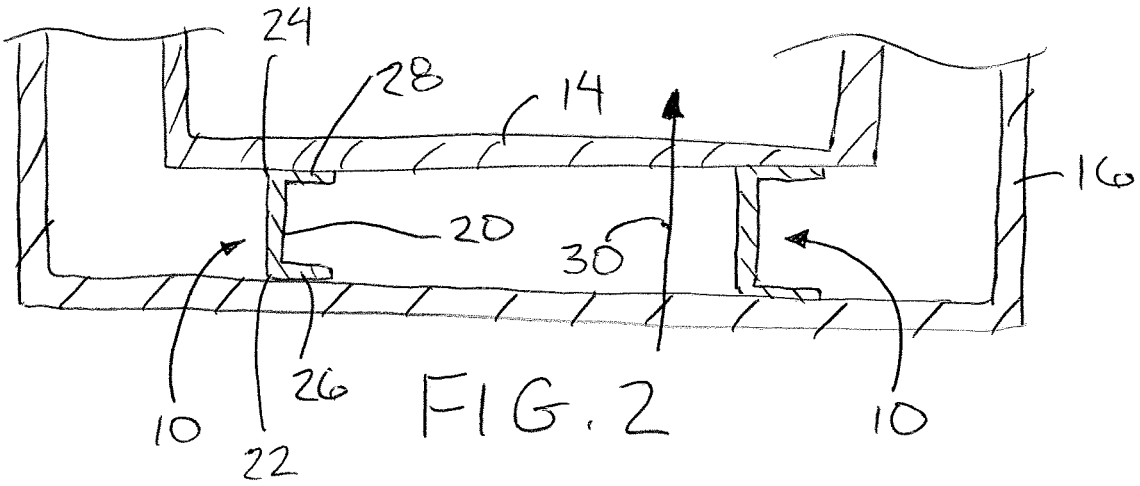
FIG. 2 is a sectional view of a portion of the building structure according to FIG. 1 illustrating the structural member incorporated therein.

Referring to the accompanying figures there is illustrated a structural member 10 for use within a heat insulated building assembly. More particularly the structural member 10 is mounted between a first structure and a second structure to provide structural support therebetween while minimizing heat transfer between the structures.

When the first structure is exposed to warmer temperatures than the second structure, the structural member 10 provides a thermal break against the flow of heat from the first structure towards the second structure. The reverse occurs when the second structure is exposed to warmer temperatures than the first structure. In environments where the first structure is an external building structure and the second building structure is an internal building structure exposed to cooler air than the first structure, the thermal break provided by the structural member 10 can be useful in minimizes condensation on the exterior of the first structure.

The thermal break provided by the structural member 10 may also be used in combination with other thermal break devices such as the thermal break provided by an additional layer of a different material which is less conductive.

In the illustrated embodiment, the building structure comprises an air handling unit 12, for example of the type which mounts on the exterior of a building, such as on the roof of the building. The unit 12 is used for circulating conditioned air through occupied spaces of the building. The unit includes an outer casing 14 defining a first building structure which is exposed to outdoor weather. The unit 12 further includes an inner casing 16 received within the outer casing which receives the conditioned air circulated therethrough such that the conditioned air is kept separate from the surrounding outdoor air. The inner casing 16 is supported relative to the outer casing to define an insulated space therebetween which is mostly filled with resilient heat insulating material, for example foam or fiber insulating materials. In this instance, the structural member 10 comprises one structural element of a plurality of elements connected between the inner and outer casing so as to provide the functions of distance-keeping, stiffening, and load-supporting structural framing elements between the outer casing functioning as a first building structure and the inner casing functioning as a second building structure.

The structural member 10 is formed of folded sheet metal so as to be elongate in a longitudinal direction of the member. The structural member includes a web portion 20 spanning the full length of the member in the longitudinal direction while spanning perpendicularly to the longitudinal direction in a gradient direction between a first edge 22 and an opposing second edge 24 of the web portion that are parallel and spaced apart from one another so as to span in the longitudinal direction together with the web portion.

The structural member further includes a first mounting portion 26 joined integrally along the first edge 22 so as to be formed from a common blank of sheet metal with the web portion. The first mounting portion 26 is folded perpendicularly to the web portion so as to be suited for structural connection to the outer casing, for example using fasteners or other suitable joining techniques.

The structural member also includes a second mounting portion 28 joined integrally along the second edge 24 of the web portion so as to be formed together from a common blank of sheet metal with the web portion. The second mounting portion 28 is folded perpendicularly to the web portion so as to be suited for structural connection to the inner casing, for example using fasteners or other suitable joining techniques.

The structural member is installed in the heat insulating assembly between the first and second building structures such that the web portion is parallel to the temperature gradient direction 30 extending from the first building structure to the second building structure perpendicularly to the longitudinal direction.

To reduce heat conduction across the web portion of the structural member in the temperature gradient direction 30, a plurality of slots 32 are formed in the web portion so as to be penetrated fully through the web portion between the opposing faces thereof. Although various embodiments of the slots are illustrated in the accompanying figures and described in the following, the common features of the slots will first be described.

Each slot 32 is generally elongate between two opposing ends of the slot so as to follow a generally non-linear path between the opposing ends of the slot. Substantially the entirety or at least the majority of the length of each slot between the opposing ends thereof is oriented so as to be both nonparallel and non-perpendicular to the longitudinal direction of the first and second edges of the web portion.

Figure 3:
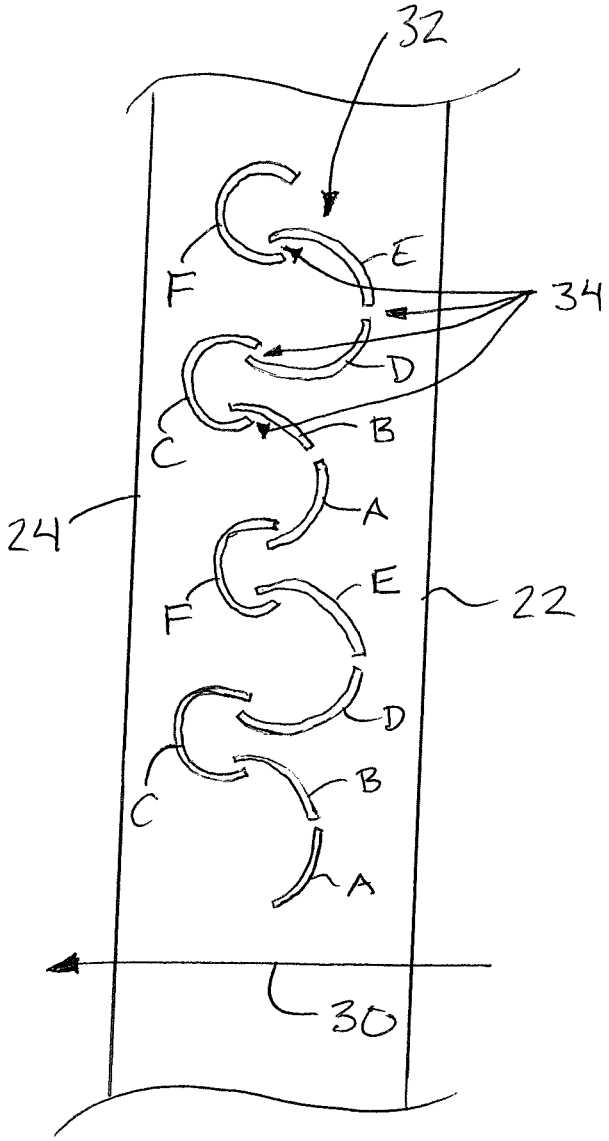
FIG. 3 is an elevational view of an enlarged portion of the structural member according to FIG. 2.
Figure 4:
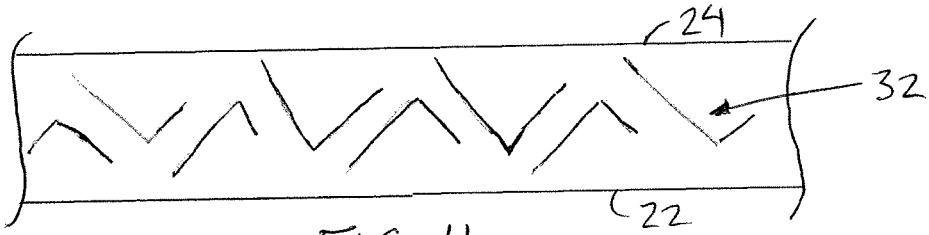
FIG. 4 is an elevational view of the structural member according to a second embodiment.
Figure 5:
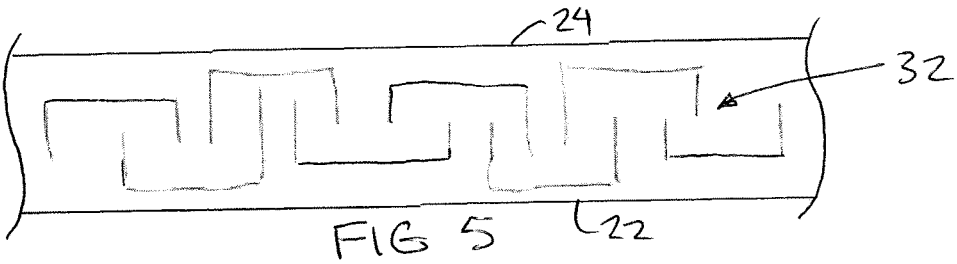
FIG. 5 is an elevational view of the structural member according to a third embodiment.
Figure 6:
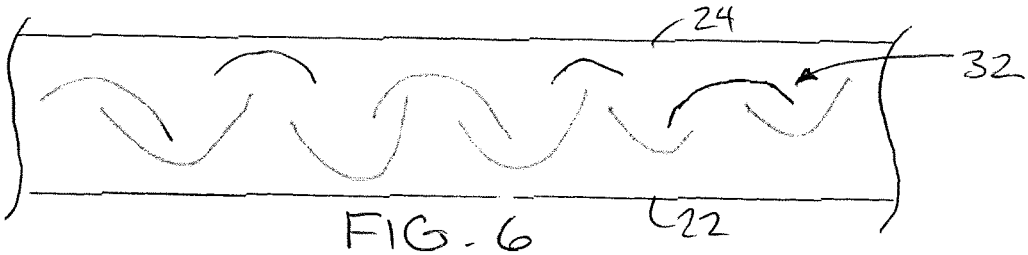
FIG. 6 is an elevational view of the structural member according to a fourth embodiment.
Figure 7:
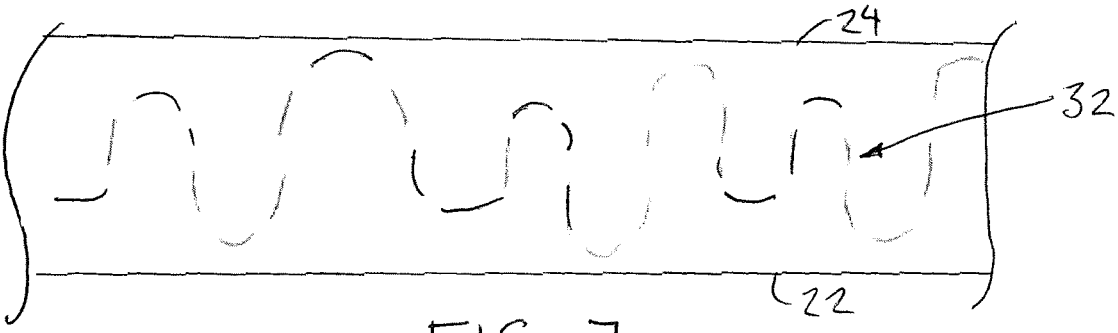
FIG. 7 is an elevational view of the structural member according to a fifth embodiment.

Turning now more particularly to the first embodiment in FIG. 3, in this instance the slots 32 comprises a repeating sequence of six different slot types labelled A through F, arranged substantially in series with one another in a row extending in the longitudinal direction of the structural member. Each slot 32 in this instance is generally arcuate in shape so as to define opposing concave and convex edges which are generally parallel to one another along opposing sides of the slot between the opposing ends of the slot. Each slot type A through F has a respective radius of curvature which is different from the radius of curvature of the other slots. The slots also vary in length from one another between the opposing ends thereof. Each slot is a generally continuous arc so as to define an apex centrally thereon between the opposing ends of the arc.

As shown in FIG. 3, some of the slots, namely slots A, B, D and E, comprise first slots in which the convex edge thereof is nearest to the first edge 22 of the web portion. The remaining slots, namely slots C and F, comprise second slots in which the convex edge thereof is nearest to the second edge 24 of the web portion. The slots are arranged such that each second slot includes two of the first slots adjacent thereto within the sequence of slots oriented in the longitudinal direction.

The slots are further arranged such that the apex of each slot is not aligned with an axis in the longitudinal direction or an axis in the gradient direction that passes through the ends or the apex of any other slots, including the two adjacent slots. Furthermore, the ends of each slot are similarly misaligned with an axis in the longitudinal direction or an axis in the gradient direction passing through either end of one or both of the adjacent slots in the sequence of slots.

The slots are oriented relative to one another such that at least some of the slots are arranged in a nesting configuration relative to other ones of the slots. That is, if an imaginary line or segment is connected between the ends of either one of the second slots, the two adjacent first slots each traverse the imaginary line or segment so that one end of each of the first slots is located within the area bounded by the second slot.

A material bridge 34 is formed between each adjacent pair of slots to provide structural continuity in the web portion between the opposing first and second edges thereof. If connecting a heat conducting path from the first edge to the second edge of the web portion across each of the material bridges 34, at least some of the bridges of material 34 require that a portion of the path extends in the opposite direction relative to the temperature gradient direction 30 in order to conduct heat from the first edge to the second edge.

Turning now more generally to FIGS. 4 through 7, each of the further embodiments exemplifies one or more of the features noted above with regard to the first embodiment of FIG. 3. As illustrated, most of the embodiments include slots 32 which are non-linear between the opposing ends thereof while being mostly in a direction which is neither parallel nor perpendicular to the longitudinal direction of the edges of the web portion. Furthermore, the apexes of any non-linear shape slots are typically misaligned with apexes and/or ends of adjacent slots in the longitudinal or gradient directions. The bridges 34 of material between adjacent slots thus defines a convoluted heat transfer path for optimizing resistance to heat conduction in the direction of the temperature gradient while minimizing lines of weakness along axes oriented in the longitudinal direction or the gradient direction.

When forming the structural member, the slot pattern is typically formed in a sheet metal blank prior to formation of the first and second mounting portions. Accordingly, by minimizing relative alignment between the slots for minimizing lines of weakness in the longitudinal or gradient directions, it is less likely for any undesirable bending of the sheet metal to occur when folding the first and second mounting portion relative to the web portion.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A structural member for use as a distance keeping, stiffening and load-supporting structural framing element between a first building structure and a second building structure across which there exists a temperature differential, the structural member comprising:

a web portion which is elongate in a longitudinal direction of the structural member and which includes opposing first and second edges of the web portion that extend in the longitudinal direction of the structural member, the web portion spanning between the first and second edges in a temperature gradient direction oriented perpendicularly to the longitudinal direction;

a first mounting portion joined to the web portion along the first edge of the web portion so as to be oriented transversely to the web portion for structural connection to the first building structure;

a second mounting portion joined to the web portion along the second edge of the web portion so as to be oriented transversely to the web portion for structural connection to the second building structure; and a plurality of slots penetrated through the web portion at spaced apart locations relative to one another;

the slots being oriented primarily non-parallel to the first and second edges of the web portion;

the slots defining a plurality of material bridges connected between the slots; and the slots being located such that at least some of the material bridges require heat transfer across the material bridge to travel in a direction opposite to the temperature gradient direction.

2. The structural member according to claim 1 wherein the slots are oriented so as to be primarily non-parallel and non-perpendicular to the first and second edges of the web portion.

3. The structural member according to claim 1 wherein each slot is non-linear in shape between opposing ends of the slot.

4. The structural member according to claim 3 wherein the slots include a plurality of arcuate shaped slots having different radii of curvature relative to one another.

5. The structural member according to claim 1 wherein each slot defines an apex between a pair of opposing ends of the slot, the apex of each slot being misaligned in both the gradient direction and the longitudinal direction relative to the apex of more than one adjacent slot.

6. The structural member according to claim 1 wherein each slot defines an apex between a pair of opposing ends of the slot, the apex of each slot being misaligned in both the gradient direction and the longitudinal direction relative to the ends of at least one adjacent slot.

7. The structural member according to claim 1 wherein each slot extends between a pair of opposing ends of the slot, the ends of each slot being misaligned in both the gradient direction and the longitudinal direction relative to the ends of at least one adjacent slots.

8. The structural member according to claim 1 wherein at least some of the slots comprise a non-linear slot extending between opposing ends of the slot, and wherein at least some of the slots traverse an imaginary line connected between the ends of respective ones of the non-linear slots so as to be at least partly nested into the respective ones of the non-linear slots.

9. The structural member according to claim 1 wherein the slots include a plurality of first slots which are arcuate in shape such that a convex edge of the slot is nearest to the first edge of the web portion and a plurality of second slots which are arcuate in shape such that a concave edge of the slot is nearest to the first edge of the web portion.

10. The structural member according to claim 9 wherein each first slot includes at least one second slot adjacent thereto.

11. An air handling unit for supplying air to a building structure in which the air handling unit is supported externally of the building structure, the air handling unit comprising:

an outer casing adapted to be supported externally of the building so as to be exposed to outdoor weather;

an inner casing supported internally within the outer casing so as to receive conditioned air therein for circulation within the building structure in which the inner casing is spaced apart from the inner casing by an insulating gap therebetween; and a plurality of structural members connected between the inner casing and the outer casing for use as a distance keeping, stiffening and load-supporting structural framing element between inner casing and the outer casing, the structural member comprising:

a web portion which is elongate in a longitudinal direction of the structural member and which includes opposing first and second edges of the web portion that extend in the longitudinal direction of the structural member, the web portion spanning between the first and second edges in a temperature gradient direction oriented perpendicularly to the longitudinal direction;

a first mounting portion joined to the web portion along the first edge of the web portion so as to be oriented transversely to the web portion for structural connection to the first building structure;

a second mounting portion joined to the web portion along the second edge of the web portion so as to be oriented transversely to the web portion for structural connection to the second building structure; and a plurality of slots penetrated through the web portion at spaced apart locations relative to one another;

the slots being oriented primarily non-parallel to the first and second edges of the web portion.

12. The air handling unit according to claim 11 wherein the slots are oriented so as to be primarily non-parallel and non-perpendicular to the first and second edges of the web portion.

13. The air handling unit according to claim 11 wherein each slot is non-linear in shape between opposing ends of the slot.

14. The air handling unit according to claim 13 wherein the slots include a plurality of arcuate shaped slots having different radii of curvature relative to one another.

15. The air handling unit according to claim 11 wherein each slot extends between a pair of opposing ends of the slot, the ends of each slot being misaligned in both the gradient direction and the longitudinal direction relative to the ends of at least one adjacent slots.

16. The air handling unit according to claim 11 wherein at least some of the slots comprise a non-linear slot extending between opposing ends of the slot, and wherein at least some of the slots traverse an imaginary line connected between the ends of respective ones of the non-linear slots so as to be at least partly nested into the respective ones of the non-linear slots.

17. The air handling unit according to claim 11 wherein the slots include a plurality of first slots which are arcuate in shape such that a convex edge of the slot is nearest to the first edge of the web portion and a plurality of second slots which are arcuate in shape such that a concave edge of the slot is nearest to the first edge of the web portion.

18. The air handling unit according to claim 17 wherein each first slot includes at least one second slot adjacent thereto.

19. The air handling unit according to claim 11 wherein the slots define a plurality of material bridges connected between the slots, the slots being located such that at least some of the material bridges require heat transfer across the bridge to travel opposite to the direction of the temperature gradient direction.

* * * * *